US011874035B2

(12) United States Patent
Sloan et al.

(10) Patent No.: US 11,874,035 B2
(45) Date of Patent: Jan. 16, 2024

(54) PARALLEL FLOW EXPANSION FOR PRESSURE AND SUPERHEAT CONTROL

(71) Applicant: Therma-Stor LLC, Madison, WI (US)

(72) Inventors: Scott Eric Sloan, Sun Prairie, WI (US); Daniel James Dettmers, McFarland, WI (US); Alan David Stahl, Oregon, WI (US); Walt Bernhard Waetjen, Sun Prairie, WI (US); Clifford William Calvert, Madison, WI (US)

(73) Assignee: THERMA-STOR LLC, Madison, WI (US)

( * ) Notice: Subject to any disclaimer, the term of this patent is extended or adjusted under 35 U.S.C. 154(b) by 83 days.

(21) Appl. No.: 17/465,626

(22) Filed: Sep. 2, 2021

(65) Prior Publication Data

US 2023/0064581 A1 Mar. 2, 2023

(51) Int. Cl.
*F25B 41/385* (2021.01)
*F25B 41/22* (2021.01)
(Continued)

(52) U.S. Cl.
CPC ..... *F25B 41/385* (2021.01); *F25B 5/04* (2013.01); *F25B 6/04* (2013.01); *F25B 41/22* (2021.01);
(Continued)

(58) Field of Classification Search
CPC ..... F25B 41/385; F25B 5/04; F25B 6/04; F25B 41/22; F25B 49/02; F25B 2600/2505; F25B 2700/2117
See application file for complete search history.

(56) References Cited

U.S. PATENT DOCUMENTS 3,314,248 A * 4/1967 Baker ..... F25B 41/22 62/243
6,164,081 A * 12/2000 Jensen ..... F25B 41/335 62/224
(Continued)

FOREIGN PATENT DOCUMENTS

CN 103339453 B * 3/2016 ..... F16K 17/02
CN 107289684 A * 10/2017 ..... F25B 41/062
(Continued)

OTHER PUBLICATIONS

European Search Report corresponding to European Application No. 22192029.1, dated Apr. 3, 2023, 17 pages.
Partial European Search Report EP Application No. 22192029.1 dated Jan. 18, 2023.

*Primary Examiner* — Kun Kai Ma
(74) *Attorney, Agent, or Firm* — BAKER BOTTS L.L.P.

(57) ABSTRACT

A Heating, Ventilation, and Air Conditioning (HVAC) system that is configured to receive a refrigerant from a condenser at a fixed expansion device and a variable expansion device. The system is further configured to output a first portion of the refrigerant to a first downstream HVAC component at a fixed flow rate using the fixed expansion device. The system is further configured to sense a temperature of an evaporator using a sensing bulb and to apply a first force to a pin of the variable expansion device based on the sensed temperature. The system is further configured to apply a second force to a valve of the variable expansion device via the force applied to the pin and to output a second portion of the refrigerant to a second downstream HVAC component at a variable flow rate based on the second force using the valve of the variable expansion device.

18 Claims, 4 Drawing Sheets

(51) Int. Cl.
*F25B 5/04* (2006.01)
*F25B 6/04* (2006.01)
*F25B 49/02* (2006.01)

(52) U.S. Cl.
CPC ..... *F25B 49/02* (2013.01); *F25B 2600/2505* (2013.01); *F25B 2700/2117* (2013.01)

(56) References Cited

U.S. PATENT DOCUMENTS

| | | | | |
|---|---|---|---|---|
| 6,672,082 | B1 | 1/2004 | Maeda | |
| 6,871,507 | B1 * | 3/2005 | Goldsmith | F24F 11/70 62/305 |
| 2006/0182164 | A1 * | 8/2006 | Hart | G01K 5/326 374/E5.021 |
| 2007/0000262 | A1 * | 1/2007 | Ikegami | F25B 41/00 62/170 |
| 2020/0200453 | A1 * | 6/2020 | Moon | F16K 31/04 |

FOREIGN PATENT DOCUMENTS

| | | | | |
|---|---|---|---|---|
| EP | 0003578 | A2 | 8/1979 | |
| JP | H0220063 | U | 2/1990 | |
| JP | 2003148358 | A * | 5/2003 | |
| JP | 2010507770 | A * | 11/2003 | |
| JP | 2007046860 | A * | 2/2007 | F25B 31/002 |
| WO | 03104719 | A1 | 12/2013 | |

* cited by examiner

PARALLEL FLOW EXPANSION FOR PRESSURE AND SUPERHEAT CONTROL

TECHNICAL FIELD

The present disclosure relates generally to Heating, Ventilation, and Air Conditioning (HVAC) system control, and more specifically to an HVAC system with parallel flow expansion for pressure and superheat control.

BACKGROUND

Existing heating, ventilation, and air conditioning (HVAC) systems (e.g. refrigeration systems) typically use expansion devices that have issues creating stable operations. For example, typical expansion devices can cause pressure swings in refrigeration systems that are beyond stabilized conditions as the system hunts for equilibrium. Rapid reactions and long thermal delays cause thermoelectric expansion valves to overreact which allows too much or too little additional mass flow rate through the expansion device. Some existing HVAC systems have significant thermal lag and pressure drops that create hunting conditions in thermoelectric expansion devices. The thermal lag in these HVAC systems takes a significant amount of time for the refrigerant coil outlet conditions to show the effects of a valve adjustment. Typical thermal-mechanical controls react with a rapid response to pressure changes. The rapid pressure reaction and slow thermal reaction can cause valve adjustments to cycle well above and below the set point which creates an unstable refrigerant system.

SUMMARY

The system disclosed in the present application provides a technical solution to the technical problems discussed above. For example, the disclosed system provides a practical application by using a parallel combination of a fixed expansion device and a variable expansion device to improve the operation of an HVAC system. The fixed expansion device is configured to allow a first portion of the refrigerant flow to move at a fixed flow rate. The variable expansion device is configured to allow a second portion of the refrigerant to move at a variable flow rate. In this configuration, the fixed expansion device and the variable expansion device are in parallel with each other which reduces the amount of fluid that is transferred by either component. This allows the variable expansion device to operate within a smaller range of flow rates. Since the variable expansion device is operating within a smaller range of flow rates, the variable expansion device can react more quickly to changes and provide a faster response time. Smaller changes in flow rates improve the operation of the HVAC system by allowing more time for thermal lag to catch up to the valve movement before the HVAC system becomes unstable. The increased response time also improves the operation of the HVAC system by allowing the variable expansion device to reduce pressure drops and to reduce thermal lag for the HVAC system. This configuration provides a technical advantage over existing HVAC systems by reducing pressure swings, avoiding hunting for equilibrium, and creating an overall more stable system.

In one embodiment, the system is configured to receive a refrigerant from a condenser at a fixed expansion device and a variable expansion device. The system is further configured to output a first portion of the refrigerant to a first downstream HVAC component at a fixed flow rate using the fixed expansion device. The system is further configured to sense a temperature of a primary evaporator using a sensing bulb and to apply a first force to a pin of the variable expansion device based on the sensed temperature. Applying the first force to the pin repositions the pin within the variable expansion device. The system is further configured to apply a second force to a valve of the variable expansion device via the force applied to the pin and to output a second portion of the refrigerant to a second downstream HVAC component at a variable flow rate based on the second force using the valve of the variable expansion device.

Certain embodiments of the present disclosure may include some, all, or none of these advantages. These advantages and other features will be more clearly understood from the following detailed description taken in conjunction with the accompanying drawings and claims.

BRIEF DESCRIPTION OF THE DRAWINGS

For a more complete understanding of this disclosure, reference is now made to the following brief description, taken in conjunction with the accompanying drawings and detailed description, wherein like reference numerals represent like parts.

DETAILED DESCRIPTION

System Overview

Figure 1:
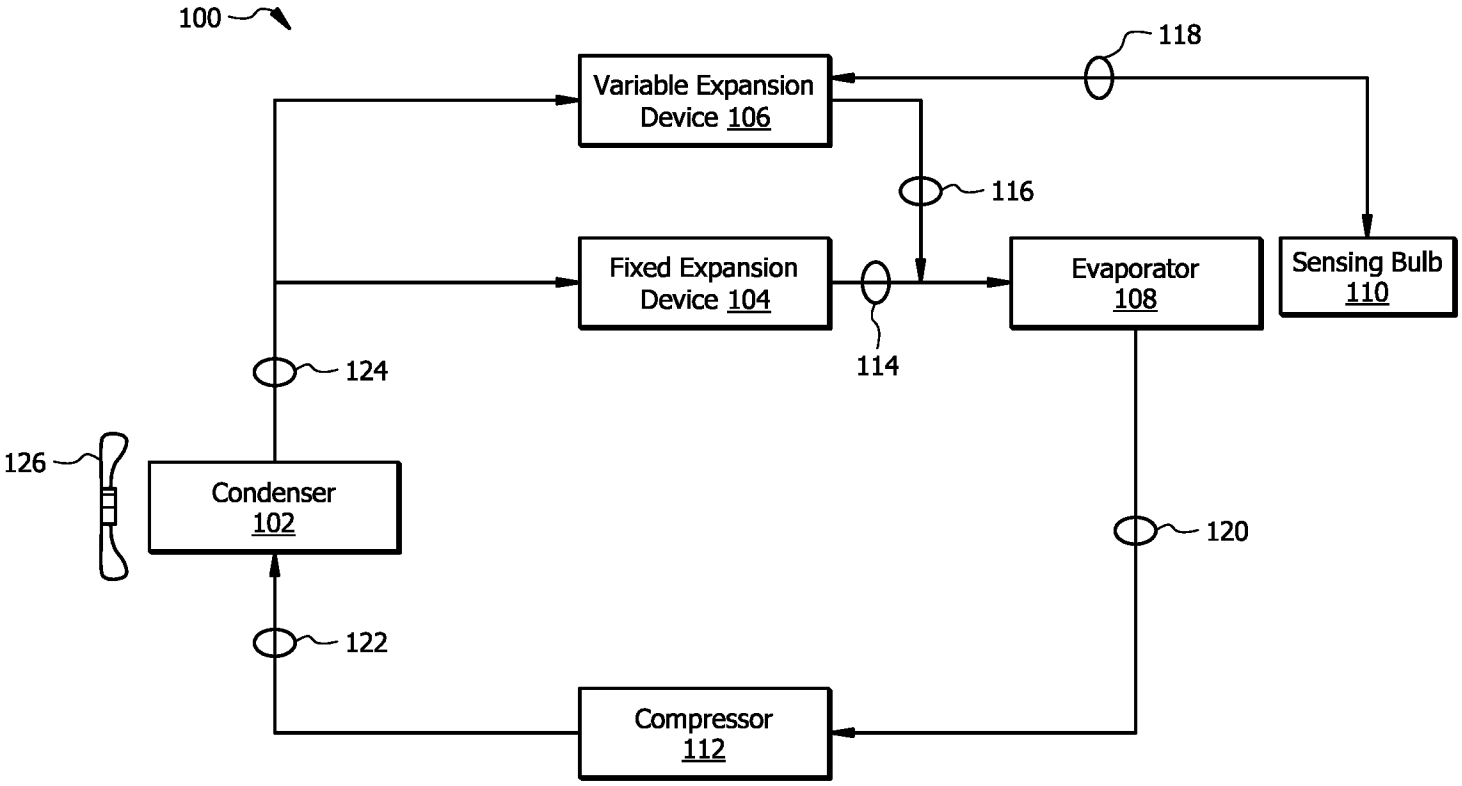
FIG. 1 is a schematic diagram of an embodiment of an HVAC system configured to use parallel flow expansion for pressure and superheat control.

FIG. 1 is a schematic diagram of an embodiment of a heating, ventilation, and air conditioning (HVAC) system 100 that is configured to use parallel flow expansion for pressure and superheat control. The HVAC system 100 is configured to use a combination of a fixed expansion device 104 and variable expansion device 106 to reduce the range of flow rates for the variable expansion device 106 which improves the operation of the HVAC system 100 by providing a faster response time, reducing pressure drops, and reducing thermal lag for the HVAC system 100.

HVAC System

An HVAC system is generally configured to control the temperature of a space. Examples of a space include, but are not limited to, a refrigerator, a cooler, a room, a home, an apartment, a mall, an office, a warehouse, a building, and the like. In one embodiment, an HVAC system 100 may comprise an evaporator 108, a compressor 112, a condenser 102, a fixed expansion device 104, a sensing bulb 110, a variable expansion device 106, and/or any other suitable type of hardware for controlling the temperature of the space. The HVAC system 100 further comprises a working-fluid conduit subsystem for moving a working fluid, or refrigerant, through a cooling cycle. The working-fluid conduit subsystem may comprise tubes, pipes, orifices, connectors, or any other suitable type of components for routing a working fluid through the HVAC system 100. The working fluid may be any acceptable working fluid, or refrigerant, including, but not limited to, fluorocarbons (e.g. chlorofluorocarbons), ammonia, non-halogenated hydrocarbons (e.g. propane), hydrofluorocarbons (e.g. R-410A), or any other suitable type of refrigerant.

Evaporator

The evaporator 108 is generally any heat exchanger configured to provide heat transfer between the air flowing through (or across) the evaporator 108 (i.e., air contacting an outer surface of one or more coils of the evaporator 108) and working fluid passing through the interior of the evaporator 108. The evaporator 108 may comprise one or more circuits of coils. The evaporator 108 is fluidically connected to the compressor 112, such that working fluid generally flows from the evaporator 108 to the compressor 112 when the HVAC system 100 is operating to provide cooling and/or dehumidification. The evaporator 108 is generally configured to receive a working fluid (e.g. a refrigerant) in a liquid state, to evaporate the working fluid into a gaseous state, and to output the evaporated working fluid 120 in the gaseous state to the compressor 112.

Compressor

The HVAC system 100 may be configured with a single-stage or multi-stage compressor 112. A single-stage compressor 112 is configured to operate at a constant speed to increase the pressure of the working fluid to keep the working fluid moving along the working-fluid conduit subsystem. A multi-stage compressor 112 comprises multiple compressors configured to operate at a constant speed to increase the pressure of the working fluid to keep the working fluid moving along the working-fluid conduit subsystem. In this configuration, one or more compressors 112 can be turned on or off to adjust the cooling capacity of the HVAC system 100. In some embodiments, a compressor 112 may be configured to operate at multiple speeds or as a variable speed compressor. For example, the compressor 112 may be configured to operate at multiple predetermined speeds. The compressor 112 is generally configured to receive the evaporated working fluid 120 from the evaporator 108 in the gaseous state, to compress the evaporated working fluid 120, and to output the compressed working fluid 122 in the gaseous state to the condenser 102.

Condenser

The condenser 102 is located downstream of the compressor 112 and is configured for rejecting heat. A fan 126 may be configured to move air across the condenser 102. For example, the fan 126 may be configured to blow outside air through a heat exchanger to help cool the working fluid. The condenser 102 is generally configured to receive the compressed working fluid 122 from the compressor 112, to condense or cool the compressed working fluid 122 from the gaseous state into a liquid state, and to output the condensed working fluid 124 in the liquid state to the variable expansion device 106 and the fixed expansion device 104.

Fixed Expansion Device

The fixed expansion device 104 comprises a tubular structure with an opening that allows the working fluid to flow through the bore of the tubular structure. In one embodiment, the flow rate of the fixed expansion device 104 is proportional to the diameter of the opening of the fixed expansion device 104. A larger opening provides a greater flow rate than a smaller opening since more working fluid can pass through the bore of the fixed expansion device 104. Examples of the fixed expansion device 104 include, but are not limited to, an orifice, a capillary tube, a tube, or a nozzle. The fixed expansion device 104 is configured to remove pressure from the condensed working fluid 124. The fixed expansion device 104 is coupled to the working-fluid conduit subsystem downstream of the condenser 102 for removing pressure from the condensed working fluid 124. In this way, the working fluid is delivered to downstream components of the HVAC system 100 and receives heat from the airflow to produce a treated airflow that is delivered by a duct subsystem to the desired space, for example, a room in the building. The fixed expansion device 104 is generally configured to receive the condensed working fluid 124 from the condenser 102 and to output a first portion 114 of the condensed working fluid 124 in a liquid state at a fixed flow rate to downstream HVAC components (e.g. the evaporator 108).

Sensing Bulb

The sensing bulb 110 comprises a hollow chamber fluidly coupled to a capillary tube. The hollow chamber is configured to store a fluid or gas 118. The capillary tube is configured to allow the fluid or gas 118 to flow into and out of the hollow chamber. The sensing bulb 110 may be formed from steel or any other suitable type of material. The sensing bulb 110 is located adjacent to the evaporator 108 and is positioned to experience or sense heat that is emitted by the evaporator 108. The sensing bulb 110 is generally configured to sense the temperature of the evaporator 108 and to output a fluid or gas 118 based on the sensed temperature of the evaporator 108 to the variable expansion device 106. The amount of fluid or gas 118 that is transferred to the variable expansion device 106 is proportional to the temperature of the evaporator 108. For example, the amount of fluid or gas 118 that is transferred to the variable expansion device 106 may increase when the temperature of the evaporator 108 increases and may decrease when the temperature of the evaporator 108 decreases.

Variable Expansion Device

The variable expansion device 106 is also configured to remove pressure from the condensed working fluid 124. One embodiment of a variable expansion device 106 is illustrated and described in conjunction with FIG. 2. The variable expansion device 106 is coupled to the working-fluid conduit subsystem downstream of the condenser 102 for removing pressure from the condensed working fluid 124. The variable expansion device 106 is generally configured to receive the condensed working fluid 124 from the condenser 102 and to output a second portion 116 of the condensed working fluid 124 in a liquid state at a variable flow rate to downstream HVAC components (e.g. the evaporator 108). The flow rate of the variable expansion device 106 is proportional to the sensed temperature of the evaporator 108. The variable expansion device 106 is fluidly coupled to the sensing bulb 110 via a capillary tube. The variable expansion device 106 is configured to receive a fluid or gas 118 from the sensing bulb 110 that is proportional to the temperature of the evaporator 108. As the amount of received fluid or gas 118 from the sensing bulb 110 increases, the variable expansion device 106 is configured to increase the flow rate of the condensed working fluid 124 that is transferred to downstream HVAC components. As the amount of received fluid or gas 118 decreases, the variable expansion device 106 is configured to decrease the flow rate of the condensed working fluid 124 that is transferred to downstream HVAC components. Additional information about the operation of the variable expansion device 106 is discussed below in FIG. 2.

Variable Expansion Device Configuration

Figure 2:
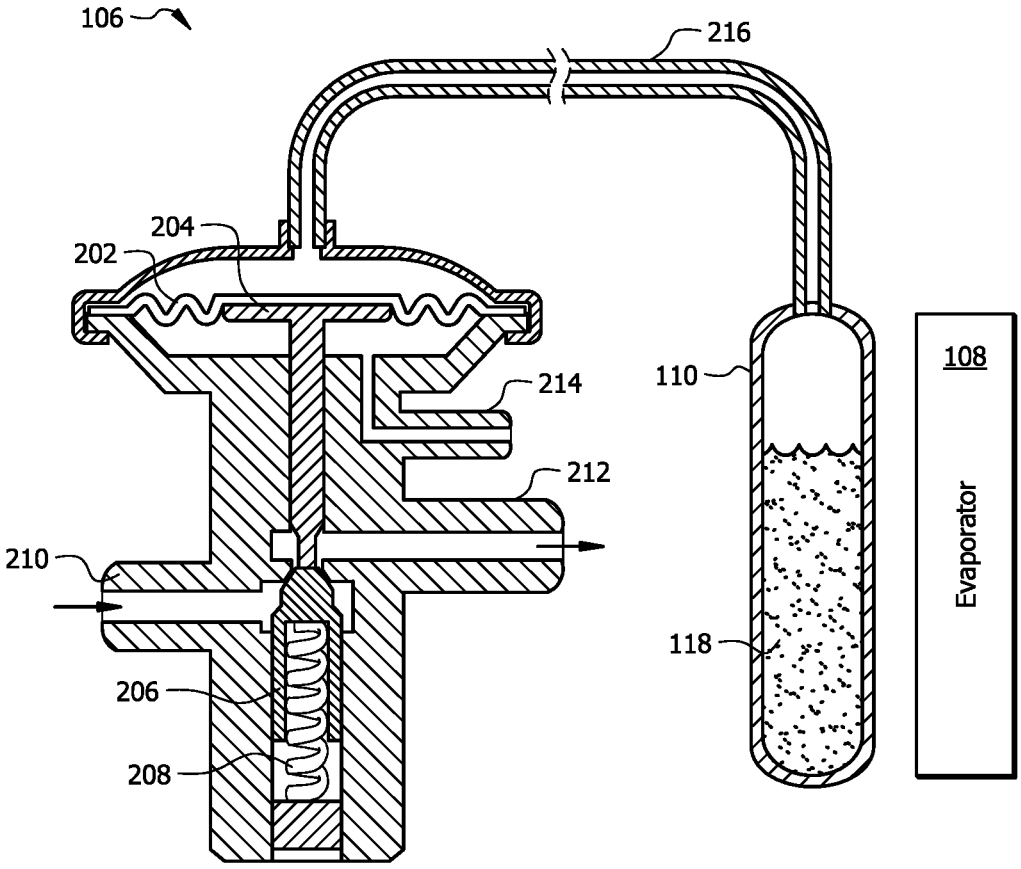
FIG. 2 is a schematic diagram of an embodiment of a variable expansion device configured to provide parallel flow expansion for the HVAC system.

FIG. 2 is a schematic diagram of an embodiment of a variable expansion device 106. In one embodiment, the variable expansion device 106 comprises a flexible diaphragm 202, a pin 204, a valve 206, and a spring 208.

The flexible diaphragm 202 is a thin material (e.g. sheet metal) that is operably coupled to the pin 204 such that the pin 204 moves up and down within the variable expansion device 106 with the flexible diaphragm 202. The flexible diaphragm 202 is configured to receive a fluid or gas 118 from the sensing bulb 110 via a capillary tube 216. The amount of fluid or gas 118 that is received from the sensing bulb 110 is proportional to the temperature of an evaporator 108. The flexible diaphragm 202 is further configured to apply a force to reposition the pin 204 based on the received fluid or gas 118 from the sensing bulb 110. In some embodiments, the variable expansion device 106 may further comprise an outlet 214 for an external equalization connection to equalize the force that is applied to the pin 204.

As the amount of fluid or gas 118 that is received from the sensing bulb 110 increases, the flexible diaphragm 202 deflects to apply a downward force on the pin 204. The downward movement of the pin 204 applies a second downward force to a valve 206 that is operably coupled to the pin 204. The valve 206 is configured to adjust a flow rate of working fluid that passes from an inlet 210 of the variable expansion device 106 to an outlet of the variable expansion device 106. As the valve 206 moves downward, the flow rate of the variable expansion device 106 increases.

As the amount of fluid or gas 118 that is received from the sensing bulb 110 decreases, the flexible diaphragm 202 deflects to decrease the downward force that is applied to the pin 204. The upward movement of the pin 204 decreases the downward force that is applied to the valve 206. As the valve 206 moves upward, the flow rate of the variable expansion device 106 decreases. The valve 206 is also operably coupled to a spring 208 that is configured to apply an upward force to the valve 206 to return the valve 206 to its normally closed position.

The size or weight of the pin 204 is proportional to a ratio between a maximum flow rate of the variable expansion device 106 and a total flow rate that is equal to the combined maximum flow rate for the fixed expansion device 104 and the variable expansion device 106. As an example, the total flow rate for the HVAC system may be five tons. The fixed expansion device 104 may be configured to provide a flow rate of two and a half tons. This allows the pin 204 of the variable expansion device 106 to be reduced to also provide a flow rate of two and a half tons. In this example, the maximum flow rate of the variable expansion device 106 is set to fifty percent of the total flow rate provided by the variable expansion device 106 and the fixed expansion device 104. This means that the size and weight of the pin 204 may be fifty percent smaller or lighter than a pin 204 that would be used to provide one hundred percent of the total flow rate. In other examples, the size or weight of the pin 204 is configured to provide any other suitable percentage of the total flow rate. For example, the size or weight of the pin 204 may be sized to provide a flow rate that is less than or equal to fifty percent of the total flow rate. Reducing the size or weight of the pin 204 reduces the range of the flow rates that are provided by the variable expansion device 106. In the previous example, reducing the size or weight of the pin 204 by fifty corresponds with a fifty percent reduction in the range of flow rates provided by the variable expansion device 106. Reducing the range of the flow rates allows the variable expansion device 106 to have a faster response time, reduced pressure drops, and reduced thermal lag for the HVAC system.

HVAC System with Secondary HVAC Components

Figure 3:
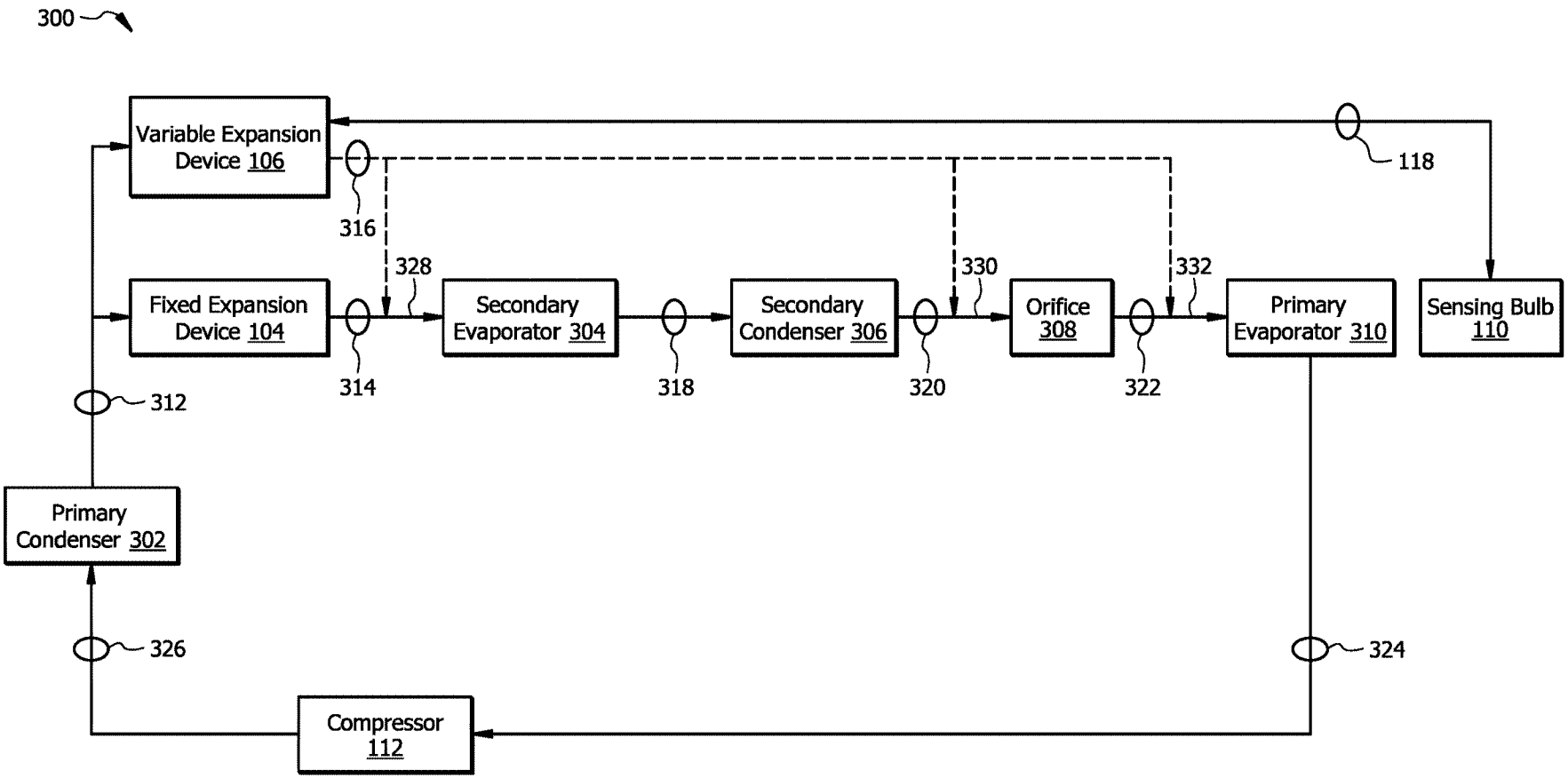
FIG. 3 is a schematic diagram of another embodiment of an HVAC system configured to use parallel flow expansion for pressure and superheat control.

FIG. 3 is a schematic diagram of another embodiment of an HVAC system 300 configured to use parallel flow expansion for pressure and superheat control. The HVAC system 300 is also configured to use a combination of a fixed expansion device 104 and variable expansion device 106 to reduce the range of flow rates for the variable expansion device 106. In FIG. 3, the HVAC system 300 comprises a primary evaporator 310, a compressor 112, a primary condenser 302, a fixed expansion device 104, a variable expansion device 106, a sensing bulb 110, a secondary evaporator 304, a secondary condenser 306, and an orifice 308. In other embodiments, the HVAC system 300 may be configured in any other suitable configuration. For example, the HVAC system 300 may add or omit one or more components shown in FIG. 3.

Primary Condenser

The primary condenser 302 is configured similar to the condenser 102 described in FIG. 1. In this configuration, the primary condenser 302 is configured to receive a working fluid (e.g. a refrigerant) in a gaseous state, to condense the working fluid into a liquid state, and output a first condensed working fluid 312 in the liquid state to the fixed expansion device 104 and the variable expansion device 106.

Fixed Expansion Device

The fixed expansion device 104 is configured to receive the first condensed working fluid 312 from the primary condenser 302 and to output a first portion 314 of the first condensed working fluid 312 in the liquid state at a fixed flow rate to downstream HVAC components (e.g. the secondary evaporator 304).

Variable Expansion Device

The variable expansion device 106 is configured to receive the first condensed working fluid 312 from the primary condenser 302 and to output a second portion 316 of the first condensed working fluid 312 in the liquid state at a variable flow rate to downstream HVAC components. For example, the variable expansion device 106 is configured to receive a fluid or gas 118 from the sensing bulb 110 that is proportional to the temperature of the primary evaporator 310. As the amount of received fluid or gas 118 from the sensing bulb 110 increases, the variable expansion device 106 is configured to increase the flow rate of the first condensed working fluid 312 that is transferred to downstream HVAC components. As the amount of received fluid or gas 118 decreases, the variable expansion device 106 is configured to decrease the flow rate of the first condensed working fluid 312 that is transferred to downstream HVAC components.

The variable expansion device 106 may be configured to provide the second portion 316 of the first condensed working fluid 312 to a variety of downstream HVAC components. For example, the variable expansion device 106 may be configured to output the second portion 316 of the first condensed working fluid 312 to an inlet 328 of the secondary evaporator 301. As another example, the variable expansion device 106 may be configured to output the second portion 316 of the first condensed working fluid 312 to an inlet 330 of the orifice 308. As another example, the variable expansion device 106 may be configured to output the second portion 316 of the first condensed working fluid 312 to an inlet 332 of the primary evaporator 310. In other examples, the variable expansion device 106 may be configured to output the second portion 316 of the first condensed working fluid 312 to an inlet of any other suitable type of HVAC component.

Sensing Bulb

In this configuration, the sensing bulb 110 is configured to sense the temperature of the primary evaporator 310 and to output a fluid or gas 118 to the variable expansion device 106 that is proportional to the sensed temperature of the primary evaporator 310.

Secondary Evaporator

The secondary evaporator 304 is configured similar to the evaporator 310 described in FIG. 1. In one embodiment, the secondary evaporator 304 is configured to receive the first portion 314 of the first condensed working fluid 312 from the fixed expansion device 104 and to receive the second portion 316 of the first condensed working fluid 312 from the variable expansion device 106. In this configuration, the secondary evaporator 304 is configured to evaporate the first portion 314 and the second portion 316 of the first condensed working fluid 312 into a gaseous state and to output a first evaporated working fluid 318 in the gaseous state.

In another embodiment, the secondary evaporator 304 may be configured to only receive the first portion 314 of the first condensed working fluid 312 from the fixed expansion device 104. In this configuration, the secondary evaporator 304 is configured to evaporate the first portion 314 of the first condensed working fluid 312 into a gaseous state and to output a first evaporated working fluid 318 in the gaseous state.

Secondary Condenser

The secondary condenser 306 is configured similar to the condenser 102 described in FIG. 1. The secondary condenser 306 is configured to receive the first evaporated working fluid 318, to condense the first evaporated working fluid 318 from a gaseous state into a liquid state, and to output a second condensed working fluid 320 in the liquid state.

Orifice

Examples of the orifice 308 include, but are not limited to, capillary tubes and nozzles. In one embodiment, the orifice 308 may be configured to receive the second condensed working fluid 320 and the second portion 316 of the first condensed working fluid 312 from the variable expansion device 106. In this configuration, the orifice 308 is configured to combine the second condensed working fluid 320 and the second portion 316 of the first condensed working fluid 312 and to output a combined working fluid 322. The orifice 308 may be configured output the combined working fluid 322 with a fixed flow rate or a variable flow rate.

In another embodiment, the orifice 308 may be configured to only receive the second condensed working fluid 320 from the secondary condenser 306. In this configuration, the orifice 308 is configured to output the working fluid 322 at either a fixed flow rate or a variable flow rate.

Primary Evaporator

The primary evaporator 310 is configured similar to the evaporator 310 described in FIG. 1. In one embodiment, the primary evaporator 310 is configured to receive the working fluid 322 and the second portion 316 of the first condensed working fluid 312. In this configuration, the primary evaporator 310 is configured to evaporate the working fluid 322 and the second portion 316 of the first condensed working fluid 312 into a gaseous state and to output a second evaporated working fluid 324.

In another embodiment, the primary evaporator 310 may be configured to only receive the working fluid 322. In this configuration, the primary evaporator 310 is configured to condense the working fluid 322 into a gaseous state and to output the second evaporated working fluid 324.

Compressor

The compressor 112 is configured to receive the second evaporated working fluid 324, to compress the second evaporated working fluid 324, and to output a compressed working fluid 326 in the gaseous state to the primary condenser 302.

Operation Process for an HVAC System

Figure 4:
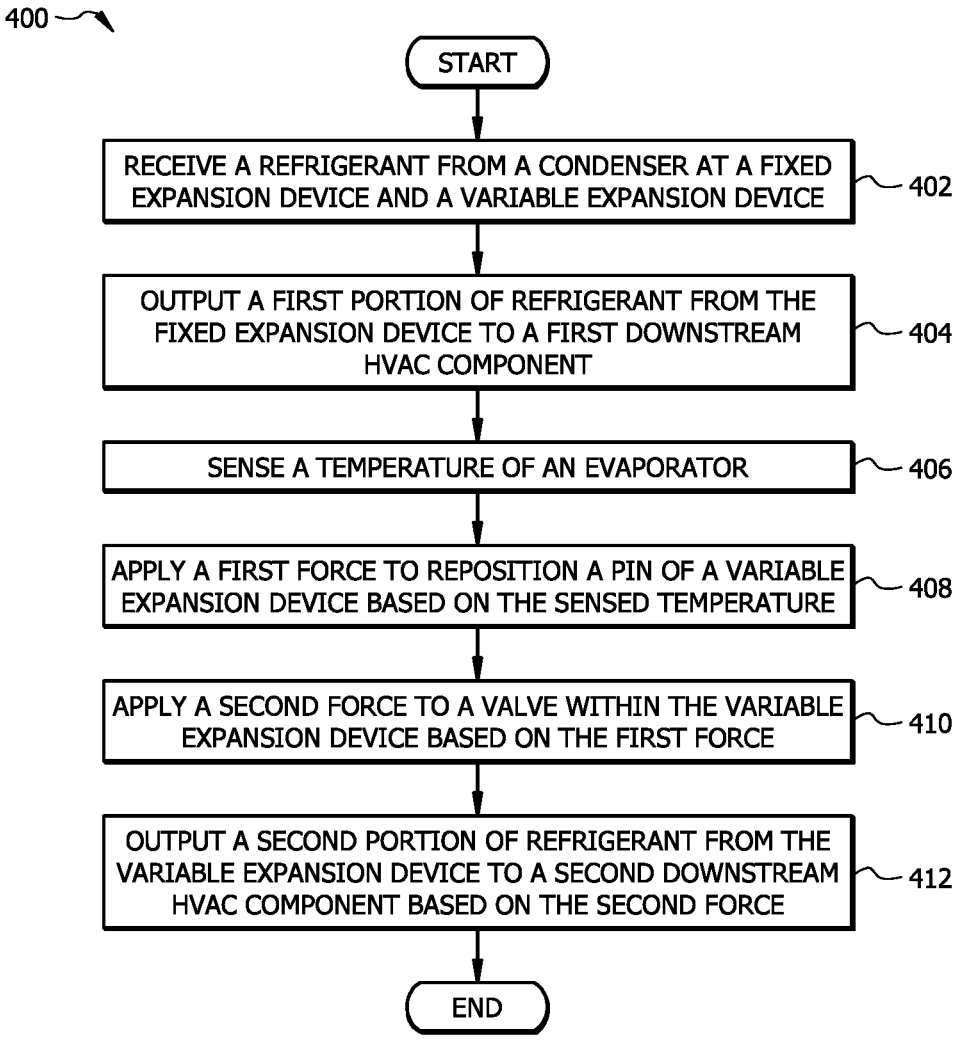
FIG. 4 is a flowchart of an embodiment of an HVAC operation process for using parallel flow expansion.

FIG. 4 is a flowchart of an embodiment of an HVAC operation process 400 for using parallel flow expansion. An HVAC system (e.g. HVAC system 100 or 300) may employ process 400 to provide a faster response time, to reduce pressure drops, and to reduce thermal lag for the HVAC system by using a parallel combination of a fixed expansion device 104 and variable expansion device 106. The parallel combination of the fixed expansion device 104 and the variable expansion device 106 reduces the workload of the variable expansion device 106 by reducing the range of flow rates for the variable expansion device 106.

At step 402, the fixed expansion device 104 and the variable expansion device 106 each receive working fluid from a condenser. Here, the fixed expansion device 104 and the variable expansion device 106 both receive the working fluid in a liquid state from a condenser, for example, the condenser 102 shown in FIG. 1 or the primary condenser 302 shown in FIG. 3.

At step 404, the fixed expansion device 104 outputs a first portion of the working fluid to a first downstream HVAC component. As an example, the fixed expansion device 104 may output the first portion of the working fluid at a fixed flow rate to an evaporator, for example, the evaporator 108 shown in FIG. 1 or the primary evaporator 310 shown in FIG. 3.

At step 406, the sensing bulb 110 senses a temperature of an evaporator. The sensing bulb 110 is configured to sense the temperature of the evaporator and to transfer an amount of fluid or gas 118 to the variable expansion device 106 that is proportional to the temperature of the evaporator. As the temperature of the evaporator increases, the sensing bulb 110 transfers more fluid or gas 118 to the variable expansion device 106. As the temperature of the evaporator decreases, the sensing bulb 110 transfers less fluid or gas 118 to the variable expansion device 106.

At step 408, the sensing bulb 110 applies a first force to a pin 204 of the variable expansion device 106 based on the sensed temperature. As discussed above in step 406, the sensing bulb 110 transfers an amount of fluid or gas 118 to the variable expansion device 106 that is proportional to the temperature of the evaporator. The fluid or gas 118 is transferred to the flexible diaphragm 202 of the variable expansion device 106 which then applies a first force to the pin 204 of the variable expansion device 106 that is proportional to the temperature of the evaporator.

At step 410, the pin of the variable expansion device 106 applies a second force to a valve 206 of the variable expansion device 106 based on the first force. The first force repositions the pin 204 within the variable expansion device 106 which then causes the second force to be applied to the valve 206 of the variable expansion device 106. A downward movement of the pin 204 applies a downward force to a valve 206 that is operably coupled to the pin 204. As the valve 206 moves downward, the flow rate of the variable expansion device 106 increases. An upward movement of the pin 204 decreases the downward force that is applied to the valve 206 which allows the valve 206 to move upward. As the valve 206 moves upward, the flow rate of the variable expansion device 106 decreases.

At step 412, the variable expansion device 106 outputs a second portion of the working fluid to a second downstream HVAC component at a variable flow rate based on the second force. As an example, the variable expansion device 106 may output the second portion of the working fluid to an evaporator, for example, the evaporator 108 shown in FIG. 1, the primary evaporator 310 shown in FIG. 3, or the secondary evaporator 304 shown in FIG. 3. As another example, the variable expansion device 106 may output the second portion of the working fluid to an orifice, for example, the orifice 308 shown in FIG. 3.

While several embodiments have been provided in the present disclosure, it should be understood that the disclosed systems and methods might be embodied in many other specific forms without departing from the spirit or scope of the present disclosure. The present examples are to be considered as illustrative and not restrictive, and the intention is not to be limited to the details given herein. For example, the various elements or components may be combined or integrated with another system or certain features may be omitted, or not implemented.

In addition, techniques, systems, subsystems, and methods described and illustrated in the various embodiments as discrete or separate may be combined or integrated with other systems, modules, techniques, or methods without departing from the scope of the present disclosure. Other items shown or discussed as coupled or directly coupled or communicating with each other may be indirectly coupled or communicating through some interface, device, or intermediate component whether electrically, mechanically, or otherwise. Other examples of changes, substitutions, and alterations are ascertainable by one skilled in the art and could be made without departing from the spirit and scope disclosed herein.

To aid the Patent Office, and any readers of any patent issued on this application in interpreting the claims appended hereto, applicants note that they do not intend any of the appended claims to invoke 35 U.S.C. § 112(f) as it exists on the date of filing hereof unless the words "means for" or "step for" are explicitly used in the particular claim.

The invention claimed is:

1. A Heating, Ventilation, and Air Conditioning (HVAC) system, comprising:

a condenser configured to:
- receive a refrigerant in a gaseous state;
- condense the refrigerant from the gaseous state into a liquid state; and
- output a first condensed refrigerant in the liquid state;

a fixed expansion device fluidly coupled to the condenser, the fixed expansion device comprising a tubular structure with an opening that is configured to:
- receive the first condensed refrigerant from the condenser;
- output a first portion of the first condensed refrigerant at a fixed flow rate, wherein the fixed flow rate is proportional to a diameter of the opening of the tubular structure;

a sensing bulb comprising:
- a hollow chamber; and
- a capillary tube fluidly coupled to the hollow chamber; and wherein the sensing bulb is configured to:
- sense a temperature of a primary evaporator; and
- output a fluid from the hollow chamber via the capillary tube based on the sensed temperature of the primary evaporator;

and a variable expansion device fluidly coupled to the condenser, wherein the variable expansion device comprises:
- a flexible diaphragm fluidly coupled to the capillary tube of the sensing bulb configured to:
  - receive the fluid from the sensing bulb; and
  - apply a first force to a pin based on the received fluid from the sensing bulb;
- the pin operably configured to apply a second force to a valve based on the first force, wherein the size of the pin is proportional to a ratio between a maximum variable flow rate of the variable expansion device and a total flow rate that is equal to the fixed flow rate plus the maximum variable flow rate of the variable expansion device; and
- the valve is fluidly coupled to the condenser and configured to:
  - receive the first condensed refrigerant from the condenser;
  - output a second portion of the first condensed refrigerant at a variable flow rate, wherein the variable flow rate is proportional to the sensed temperature of the evaporator.

2. The system of claim 1, further comprising a secondary evaporator fluidly coupled to the fixed expansion device and the variable expansion device, configured to:

receive the first portion of the first condensed refrigerant from the fixed expansion device;

receive the second portion of the first condensed refrigerant from the variable expansion device;

evaporate the first portion and the second portion of the first condensed refrigerant into a gaseous state; and output the refrigerant in the gaseous state.

3. The system of claim 1, further comprising:

a secondary evaporator fluidly coupled to the fixed expansion device, configured to:
- receive the first portion of the first condensed refrigerant from the fixed expansion device;
- evaporate the first portion of the first condensed refrigerant into a gaseous state; and
- output a first evaporated refrigerant in the gaseous state;

a secondary condenser fluidly coupled to the secondary evaporator, configured to:
- receive the first evaporated refrigerant;
- condense the first evaporated refrigerant from the gaseous state into the liquid state; and
- output a second condensed refrigerant in the liquid state;

a primary evaporator fluidly coupled to the secondary condenser and the variable expansion device, configured to:
- receive the second condensed refrigerant;
- receive the second portion of the first condensed refrigerant from the variable expansion device;
- evaporate the second condensed refrigerant and the second portion of the first condensed refrigerant into a gaseous state; and
- output a second evaporated refrigerant in the gaseous state.

4. The system of claim 3, further comprising a compressor fluidly coupled to the primary evaporator, configured to:

receive the second evaporated refrigerant;

compress the second evaporated refrigerant; and output the compressed refrigerant in the gaseous state.

5. The system of claim 1, further comprising:
a secondary evaporator fluidly coupled to the fixed expansion device, configured to:
receive the first portion of the first condensed refrigerant from the fixed expansion device;
evaporate the first portion of the first condensed refrigerant into a gaseous state; and
output the evaporated refrigerant in the gaseous state;
a secondary condenser fluidly coupled to the secondary evaporator, configured to:
receive the evaporated refrigerant;
condense the evaporated refrigerant from the gaseous state into the liquid state; and
output a second condensed refrigerant in the liquid state; and
an orifice fluidly coupled to the secondary condenser and the variable expansion device, configured to:
receive the second condensed refrigerant;
receive the second portion of the first condensed refrigerant from the variable expansion device;
combine the second condensed refrigerant and the second portion of the first condensed refrigerant; and
output the combined refrigerant at a fixed flow rate.

6. The system of claim 5, further comprising a primary evaporator fluidly coupled to the orifice, configured to:
receive the combined refrigerant;
evaporate the combined refrigerant into a gaseous state; and
output a second evaporated refrigerant in the gaseous state.

7. The system of claim 6, further comprising a compressor fluidly coupled to the primary evaporator, configured to:
receive the second evaporated refrigerant;
compress the second evaporated refrigerant; and
output the compressed refrigerant in the gaseous state.

8. The system of claim 1, further comprising:
a secondary evaporator fluidly coupled to the fixed expansion device, configured to:
receive the first portion of the first condensed refrigerant from the fixed expansion device;
evaporate the first portion of the first condensed refrigerant into a gaseous state; and
output the evaporated refrigerant in the gaseous state;
a secondary condenser fluidly coupled to the secondary evaporator, configured to:
receive the evaporated refrigerant;
condense the evaporated refrigerant from the gaseous state into the liquid state; and
output a second condensed refrigerant in the liquid state; and
an orifice fluidly coupled to the secondary condenser and the variable expansion device, configured to:
receive the second condensed refrigerant;
receive the second portion of the first condensed refrigerant from the variable expansion device;
combine the second condensed refrigerant and the second portion of the first condensed refrigerant; and
output the combined refrigerant at a variable flow rate.

9. The system of claim 8, further comprising a primary evaporator, fluidly coupled to the orifice, configured to:
receive the combined refrigerant;
evaporate the combined refrigerant into a gaseous state; and
output a second evaporated refrigerant in the gaseous state.

10. The system of claim 9, further comprising a compressor fluidly coupled to the primary evaporator, configured to:
receive the second evaporated refrigerant;
compress the second evaporated refrigerant; and
output the compressed refrigerant in the gaseous state.

11. A method for operating a Heating, Ventilation, and Air Conditioning (HVAC) system, comprising:
receiving, at a fixed expansion device, a refrigerant from a condenser;
receiving, at a variable expansion device, the refrigerant from the condenser;
outputting, by the fixed expansion device, a first portion of the refrigerant to a first downstream HVAC component at a fixed flow rate;
sensing, by a sensing bulb, a temperature of a primary evaporator;
applying a first force to a pin of the variable expansion device based on the sensed temperature, wherein:
applying the first force to the pin repositions the pin within the variable expansion device; and
the size of the pin is proportional to a ratio between a maximum variable flow rate of the variable expansion device and a total flow rate that is equal to the fixed flow rate plus the maximum variable flow rate of the variable expansion device;
applying a second force to a valve of the variable expansion device based on the first force; and
outputting, by the valve of the variable expansion device, a second portion of the refrigerant to a second downstream HVAC component at a variable flow rate based on the second force.

12. The method of claim 11, wherein applying the first force to the pin of the variable expansion device comprises transferring a fluid from the sensing bulb to a flexible diaphragm within the variable expansion device that is operably coupled to the pin.

13. The method of claim 11, wherein:
the first downstream HVAC component is a secondary evaporator; and
the second downstream HVAC component is an orifice configured to provide a fixed flow rate.

14. The method of claim 11, wherein:
the first downstream HVAC component is a secondary evaporator; and
the second downstream HVAC component is an orifice configured to provide a variable flow rate.

15. The method of claim 11, wherein:
the first downstream HVAC component is a secondary evaporator; and
the second downstream HVAC component is the primary evaporator.

16. The method of claim 11, wherein the maximum variable flow rate of the variable expansion device is less than or equal to fifty percent of the total flow rate.

17. The system of claim 16, wherein the maximum variable flow rate of the variable expansion device is less than or equal to fifty percent of the total flow rate.

18. A Heating, Ventilation, and Air Conditioning (HVAC) system, comprising:
an evaporator configured to:
receive a refrigerant in a liquid state;
evaporate the refrigerant into a gaseous state; and
output the refrigerant in the gaseous state;
a compressor fluidly coupled to the evaporator, configured to:
receive the refrigerant in the gaseous state;
compress the refrigerant; and output the compressed refrigerant in the gaseous state;

a condenser fluidly coupled to the compressor, configured to:

receive the compressed refrigerant from the compressor;

condense the compressed refrigerant from the gaseous state into the liquid state; and output the condensed refrigerant in the liquid state;

a fixed expansion device fluidly coupled to the condenser, comprising a tubular structure with an opening that is configured to:

receive the condensed refrigerant from the condenser;

output a first portion of the condensed refrigerant at a fixed flow rate, wherein the fixed flow rate is proportional to a diameter of the opening of the tubular structure;

a sensing bulb comprising:

a hollow chamber; and a capillary tube fluidly coupled to the hollow chamber; and wherein the sensing bulb is configured to:

sense a temperature of the evaporator; and output a fluid from the hollow chamber via the capillary tube based on the sensed temperature of the evaporator;

and a variable expansion device fluidly coupled to the condenser, wherein:

the variable expansion device is configured to:

receive the condensed refrigerant from the condenser;

output a second portion of the condensed refrigerant at a variable flow rate, wherein the variable flow rate is proportional to the sensed temperature of the evaporator; and the variable expansion device comprises:

a flexible diaphragm fluidly coupled to the capillary tube of the sensing bulb, configured to:

receive the fluid from the sensing bulb; and apply a first force to a pin based on the received fluid from the sensing bulb;

the pin operably configured to apply a second force to a valve based on the first force, wherein the size of the pin is proportional to a ratio between a maximum variable flow rate of the variable expansion device and a total flow rate that is equal to the fixed flow rate plus the maximum variable flow rate of the variable expansion device; and the valve fluidly coupled to the condenser and configured to output the second portion of the condensed refrigerant.

* * * * *